US011261672B2

(12) United States Patent
Mohon et al.

(10) Patent No.: US 11,261,672 B2
(45) Date of Patent: Mar. 1, 2022

(54) CENTRALIZER FOR WIRELINE TOOL

(71) Applicant: Weatherford Technology Holdings, LLC, Houston, TX (US)

(72) Inventors: Brian A. Mohon, Spring, TX (US); Bruce E. Dennis, Benbrook, TX (US); Jess V. Ford, Conroe, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 57 days.

(21) Appl. No.: 16/596,463

(22) Filed: Oct. 8, 2019

(65) Prior Publication Data

US 2021/0102429 A1 Apr. 8, 2021

(51) Int. Cl.
*E21B 17/10* (2006.01)

(52) U.S. Cl.
CPC ..... *E21B 17/1021* (2013.01); *E21B 17/1014* (2013.01); *E21B 17/1057* (2013.01); *E21B 17/10* (2013.01)

(58) Field of Classification Search
CPC .. E21B 17/10; E21B 17/1014; E21B 17/1021; E21B 17/1057
See application file for complete search history.

(56) References Cited

U.S. PATENT DOCUMENTS

| | | | | |
|---|---|---|---|---|
| 4,615,386 | A | 10/1986 | Briscoe | |
| 4,790,381 | A * | 12/1988 | Armell | E21B 17/1021 166/241.5 |
| 4,794,986 | A * | 1/1989 | Langer | E21B 17/1028 166/241.7 |
| 4,830,105 | A * | 5/1989 | Petermann | E21B 17/1021 166/241.1 |
| 5,358,040 | A | 10/1994 | Kinley et al. | |
| 5,785,125 | A | 7/1998 | Royer | |
| 6,920,936 | B2 | 7/2005 | Sheiretov et al. | |
| 7,090,007 | B2 | 8/2006 | Stuart-Bruges et al. | |
| 7,708,064 | B2 * | 5/2010 | Sehsah | E21B 17/1028 166/241.6 |
| 2015/0376960 | A1 | 12/2015 | Rodrigue et al. | |
| 2017/0009536 | A1 | 1/2017 | Kiess et al. | |
| 2020/0408074 | A1 * | 12/2020 | Yang | E21B 47/092 |

* cited by examiner

*Primary Examiner* — Tara Schimpf
(74) *Attorney, Agent, or Firm* — Blank Rome LLP

(57) ABSTRACT

A centralizer assembly replaces an existing centralizer of a wireline tool so the tool can be used with smaller casing, such as casing smaller than 6-in. The assembly includes first and second centralizer units that replace the existing centralizer on a mandrel. Each unit has a sleeve that fits in a recess of the mandrel, and each unit has slider blocks disposed together in the recess on opposing sides of a divider on the sleeve. Arms hingedly connected to the blocks on each unit connect together at a joint having a roller for engaging in the casing. On each unit, a common pin is disposed through the slider blocks, and biasing elements on the common pin bias the blocks toward one another with different amounts of bias.

22 Claims, 13 Drawing Sheets

CENTRALIZER FOR WIRELINE TOOL

BACKGROUND OF THE DISCLOSURE

Wireline centralizers are used on wireline tools to keep the tool centered in casing. Several types of centralizers are available, including spring box centralizers and wireline roller centralizers. Typically, the wireline roller centralizer is designed for use in a large range of casing sizes.

For example, FIG. 1 shows an elevational view of a typical wireline roller centralizer 20 disposed on a wireline tool 10, which has a sonde 14. The wireline tool 10 has a tool body 12 from which the centralizer 20 and the sonde 14 extend. The centralizer 20 has a mandrel 22 connected at one end to the tool body 12, and the mandrel 22 supports the sonde 14 from its distal end. A plurality of radial supports 30 disposed about the mandrel 22 can engage a surrounding casing wall to centralize the sonde 14 in the casing 16.

In particular, the mandrel 22 has first and second recesses 26*a-b* separated by an upset. First and second slider blocks 32*a-b* are disposed respectively in the first and second recesses 26*a-b*. Each of the radial supports 30 has a first arm 36*a* hingedly connected at a hinged connection 38*a* to the first slider block 32*a*, and each has a second arm 36*b* hingedly connected at a hinged connection 38*b* to the second slider block 32*b*. The distal ends of the two arms 36*a-b* are hingedly connected together at a hinged connection 38*c* having a roller for riding along casing wall. The upper slider block 32*a* can include a limiting sleeve 34 that limits the extent of movement along the mandrel 22.

For the roller centralizer 20 to be useable in a large range of casing sizes, the corresponding arms 36*a-b* are relatively long. For example, the roller centralizer 20 may be used for casings sizes of 4.5-in to 18-in, and the arms 36*a-b* may each have a length of 15-in. Because the arms 36*a-b* are long, the arms 36*a-b* when run in smaller casing sizes may have a considerable effective radial play (linkage slop in the hinged connections 38*a-c*), resulting in high levels of eccentricity. If the wireline tool 10 is run having the sonde 14 requiring a high level of concentricity to the inside casing surface, the resulting eccentricity from the centralizer 20 due to the linkage slop can frustrate efforts to obtain quality log data. For example, such tool eccentricity is a known issue for certain wireline tools, such as ultrasonic casing inspection tools.

For example, FIGS. 2A-2B illustrate sectioned views of the conventional roller centralizer 20 of the prior art in stages of movement, including insertion in direction I into a smaller diameter casing 16. As shown in FIG. 2A, the distal slider block 32*b* in the distal recess 26*b* shoulders against an upset shoulder 25*b*. The distal arms 36*b* engage the smaller diameter casing 16, and bow springs 35*a-b* of the arms 36*a-b* space out the proximal slider block 36*a*, which has an allowable travel T dictated by the sleeve 34.

Eventually on insertion, the arms 36*a-b* retract inward as the proximal slider block 32*a* reaches the end of its stroke, and the rollers on the hinged connections 38*c* of the arms 36*a-b* engage inside the casing 16. The shouldering of the distal block 36*b* on the upset shoulder 25*b* ensures the proximal block 32*a* has adequate travel allowance for the maximum operating range of the centralizer 20. (As will be appreciated, the centralizer 20 must also have adequate block travel in both proximal and distal locations to prevent getting stuck.) For example, FIG. 2B shows the roller centralizer 20 during removal in direction R with the proximal block 62*a* engaged with proximal upset 25*a*.

As noted, the long arms 36*a-b* run in the smaller casing 16 have a considerable effective radial play (linkage slop), and this play or slop allows the mandrel 22 to be supported off center from the casing wall, which can affect the wireline tool's measurements. Briefly, FIG. 3 diagrams extreme cases of the effect of eccentricity on a wireline tool having a sonde 14. The sonde 14 is shown completely decentralized against the casing 16 with the sonde 14 at different orientations relative to the casing wall. Higher signal returns for the sonde 14 may be achieved at 0 and 180 degrees because the transmission from/return to the sonde 14 is more orthogonal to the casing wall. However, the greatest loss of signal returns occur at 90 and 270 degrees. As will be appreciated, a given tool may be decentralized anywhere between being centralized and being completely decentralized as shown, and the sonde 14 may be oriented at any orientation between those diagramed here.

For this reason, complicated algorithms within logging software have been created to analytically correct for eccentricity of the sonde 14 on the wireline tool 10. Typically, a prediction of amplitude loss can be made based on a geometric calculation as a function of a measured eccentricity, measured radius, and head size. If there is a certain agreement between measured amplitude fluctuations and calculated losses, then the software may determine that the amplitude fluctuations are due to a non-normal incident angle of the sonde 14 to the casing 16 resulting from the tool's eccentricity. As will be appreciated, these secondary determinations to analytically correct for eccentricity of the tool 10 can easily lead to unintended inaccuracies in the log results.

The linkage slop or radial arm play of the centralizer arms 36*a-b* of FIGS. 2A-2B increases with the decrease in the inner diameter of the casing 16 (i.e., with decreasing arm angle). For a standard wireline roller centralizer 20, for example, high eccentricity may occur when the casing size has an inner diameter (ID) less than 6.5-in, which can correspond to an arm angle less than 15-deg. To depict this, FIG. 4 graphs eccentricity of the conventional roller centralizer 20 as a function of inner casing diameters relative to radial arm play.

Radial arm play for an inner casing diameter of 12-in at the right of the graph may be less than 0.05 in, but the radial arm play would increase to as much as 0.2-in for an inner casing diameter of 4-in at the left of the graph. For some wireline tools and sondes, the allowable amount of eccentricity has a preferred limit in which accurate measurements can be made. For example, one such a limit can be 1% eccentricity of the inner casing diameter, as depicted by the dashed line in the graph. As can be seen, the eccentricity from the radial arm play in the conventional roller centralizer exceeds the preferred limit when the inner casing diameter is less than about 6.5-in.

In addition to problems with eccentricity, the roller centralizer 20 is spring loaded having an axial spring load applied to the slider blocks 32*a-b*. For example, the centralizer 20 of FIGS. 1 & 2A-2B uses the bow springs 35*a-b*. Due to the spring loading, the resulting centralizing force as a function of casing size (and thus the centralizer arm angle) is highly non-linear. The centralizing force will approach zero as the arms 36*a-b* approach an angle of zero with respect to the center axis of the tool 10. If the minimum centralizing force is designed around the minimum casing ID (minimum arm angle), the centralizing load at larger casing sizes can be significantly higher. However, this design creates problems with wear of the rollers at the arm joints 38*c*. If the centralizing force at larger casing sizes is designed to centralize the tool 10 and limit roller wear, the centralizing force at small casing sizes would be insufficient.

Some solutions for issues with the centralizing force have been proposed. For example, U.S. Pat. No. 6,920,936 addresses the non-linearity of centralizing force with respect to casing diameter by proposing a centralizer that utilizes a cam profile that changes the rate of compression at different casing sizes. U.S. Pat. No. 4,615,386 addresses the non-linearity of centralizing force with respect to casing diameter by utilizing two methods of spring force application in a single centralizer. A cam-activated spring housed in the slider blocks is used to produce a high centralizing force at small casing diameters and a low centralizing force at large casing diameters. Also, an axial spring parallel to the cam-activated spring is compressed by slider block movement to produce a low centralizing force at small casing diameters and a high centralizing force at large casing sizes. Although these two solutions noted above may produce an acceptable centralizing force profile over the range of casing sizes, both of these solutions are complex and costly, and they require a larger design envelope (larger form factor) on the mandrel of the centralizer.

Although prior art wireline roller centralizers may be effective, operators are continually striving to improve how to centralize wireline tools run in casing of various diameters. To that end, the subject matter of the present disclosure is directed to overcoming, or at least reducing the effects of, one or more of the problems set forth above.

SUMMARY OF THE DISCLOSURE

An assembly is disclosed for converting a given centralizer of a wireline tool for use with smaller diameter casing. The wireline tool has a mandrel with first and second recesses separated by an upset. The given centralizer has first and second slider blocks disposed respectively in the first and second recesses and has a plurality of given radial supports. Each of the given radial supports has a first arm hingedly connected to the first slider block, and each of the radial supports has a second arm hingedly connected to the second slider block and hingedly connected to the first arm.

The assembly comprises first and second centralizers replacing the given centralizer on the mandrel. The first centralizer has a first divider disposed in the first recess and has its own set of slider blocks disposed together in the first recess on respective sides of the first divider. One of the slider blocks has one arm hingedly connected thereto, and the other slider block has another arm hingedly connected thereto and hingedly connected to the one arm.

The second centralizer is comparably arranged as the first centralizer. The second centralizer has a second divider disposed in the second recess and has its own set of slider blocks disposed together in the second recess on respective sides of the second divider. One of the slider blocks has one arm hingedly connected thereto, and the other slider block has another arm hingedly connected thereto and hingedly connected to the one arm.

Each of the respective slider blocks can comprise at least two pieces fitting together in the respective recess around the mandrel. Each of the dividers can comprise a sleeve disposed in the respective recess. The sleeve has a shoulder for the respective divider and has the respective slider blocks disposed on the sleeve on opposing sides of the shoulder. Each of the sleeves can comprise at least two pieces fitting together in the respective recess around the mandrel.

Each of the respective slider blocks for the centralizers can comprise a common pin disposed through adjacent shoulders on the respective slider blocks. The common pin has a first shoulder end and has a first biasing element disposed on the common pin between the first shoulder end and a first of the adjacent shoulders. The common pin also has a second shoulder end and has a second biasing element disposed on the common pin between the second shoulder end and a second of the adjacent shoulders.

The first biasing element can comprise a first stiffnesses, whereas the second biasing element can comprise a second stiffness different from the first stiffness. A first shouldering distance between the first end of the common pin and the first adjacent shoulder can be greater than a second shouldering distance between the second end of the common pin and the second adjacent shoulder.

The hinged connections between the respective arms on the first and second slider blocks can each comprise a roller.

The first centralizer can comprise a plurality of first radial supports with each of the first radial supports having a set of the arms. Likewise, the second centralizer can comprise a plurality of second radial supports with each of the second radial supports having a set of the arms. The radial supports can be arranged about the slider blocks alternatingly closer to edges of the slider blocks.

A centralizer is also disclosed herein for use on a wireline tool in casing having a number of inner diameters. The wireline tool has a mandrel with a dividing upset. The centralizer comprises first and second slider blocks and first and second arms. The first slider block is disposed on the mandrel on a first side of the dividing upset, and the second slider block is disposed on the mandrel on a second side of the dividing shoulder. The first and second slider blocks are separable from one another.

The first arm is hingedly connected to the first slider block, and the second arm is hingedly connected to the second slider block and hingedly connected to the first arm. First and second biasing elements are arranged between the first and second slider blocks. The first biasing element biases an initial extent of separation between the first and second slider blocks, while the second biasing element biases a subsequent extent of the separation between the first and second slider blocks.

In one arrangement, the first slider block can comprise a first shoulder facing away from the dividing upset, and the second slider block can comprise a second shoulder facing away from the dividing upset. A common pin can be disposed through the first and second shoulders on the respective slider blocks. The common pin can have third and fourth shoulders.

In this arrangement, the first biasing element can be disposed on the common pin between the first shoulder of the first slider block and the third shoulder of the common pin. The second biasing element can be disposed on the common pin between the second shoulder of the second slider block and the fourth shoulder end of the common pin.

In any of the arrangements, the first biasing element can comprise a first stiffnesses, while the second biasing element can comprise a second stiffness different from the first stiffness. Moreover, a first shouldering distance between the first shoulder of the first slider block and the third shoulder of the common pin can be greater than a second shouldering distance between the second shoulder of the second slider block and the fourth shoulder of the common pin. Further, the initial extent can be shorter than the subsequent extent.

For assembly, the dividing upset can comprise a sleeve disposed in a recess of the mandrel. The sleeve can have a dividing shoulder for the dividing upset and can have the respective slider blocks disposed on the sleeve on opposing sides of the dividing shoulder.

A centralizer is further disclosed for use on a wireline tool in casing having a number of inner diameters. The wireline tool has a mandrel with a dividing upset. The centralizer comprises first and second blocks disposed on the mandrel on opposite sides of the dividing upset. Arms hingedly connected to the slider block are also hingedly connected together. A common pin is disposed through the shoulders on the respective slider blocks, and the common pin has shoulders. A first biasing element is disposed on the common pin between the shoulder of the first slider block and the shoulder of the common pin, and a second biasing element is disposed on the common pin between the shoulder of the second slider block and the shoulder end of the common pin.

The first biasing element can comprise a first stiffnesses, and the second biasing element can comprise a second stiffness different from the first stiffness. Moreover, a first shouldering distance between the shoulder of the first slider block and the shoulder of the common pin can be greater than a second shouldering distance between the shoulder of the second slider block and the shoulder of the common pin.

A method is disclosed herein for centralizing a wireline tool in casing having a number of inner diameters. The wireline tool has a mandrel with a dividing upset. The method comprises: supporting first and second slider blocks disposed on the mandrel on opposite sides of the dividing upset; engaging a hinged connection between first and second arms inside the casing; urging separation of the first and second slider blocks on the mandrel relative to the dividing upset due to the engagement; basing against the urging of the first and second slider blocks with a first basing force for an initial extent of the separation; and basing against the urging of the first and second slider blocks with a second basing force for a subsequent extend of the separation the second biasing force being greater than the first biasing force.

To bias against the urging of the first and second slider blocks, the biasing can be done with a first biasing element having a first stiffnesses. By contrast, the biasing can be done with a second biasing element having a second stiffness different from the first stiffness. Moreover, biasing against the urging of the first and second slider blocks can comprise biasing for the initial extent being shorter than the subsequent extent.

The foregoing summary is not intended to summarize each potential embodiment or every aspect of the present disclosure.

DETAILED DESCRIPTION OF THE DISCLOSURE

Figure 1:
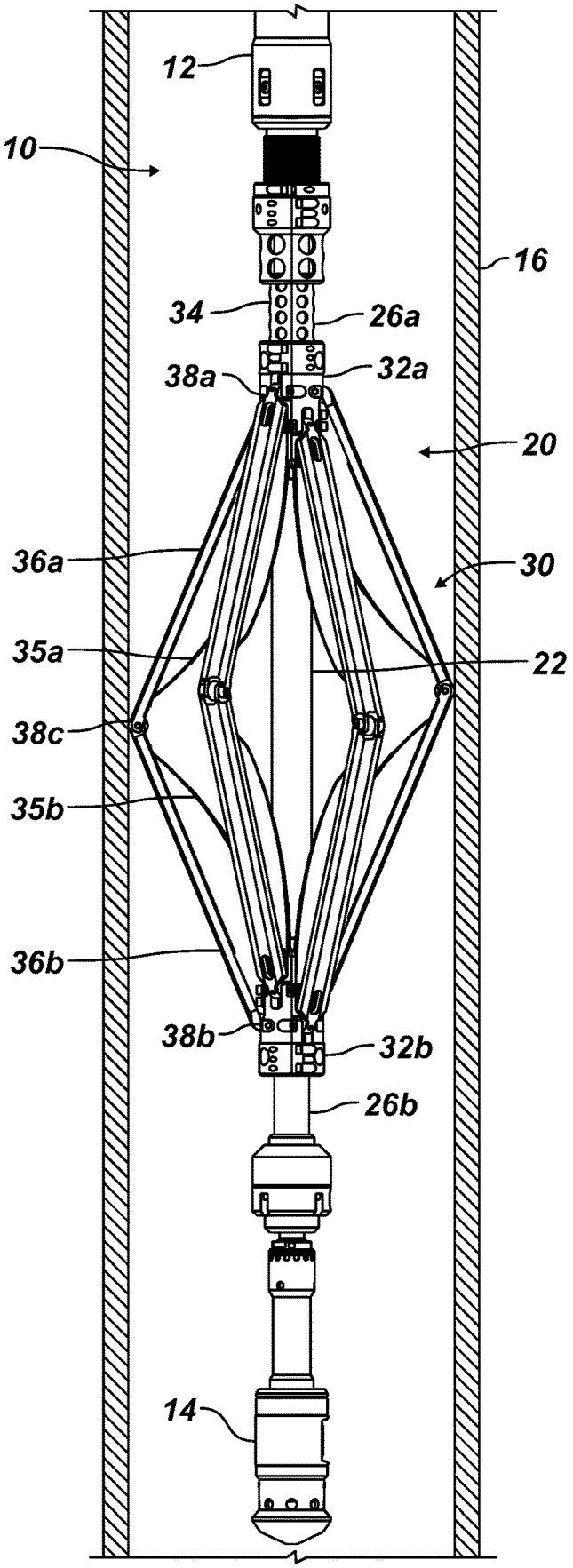
FIG. 1 (Prior Art)
FIG. 1 illustrates an elevational view of a portion of a wireline tool having a conventional roller centralizer of the prior art.
Figure 2A:
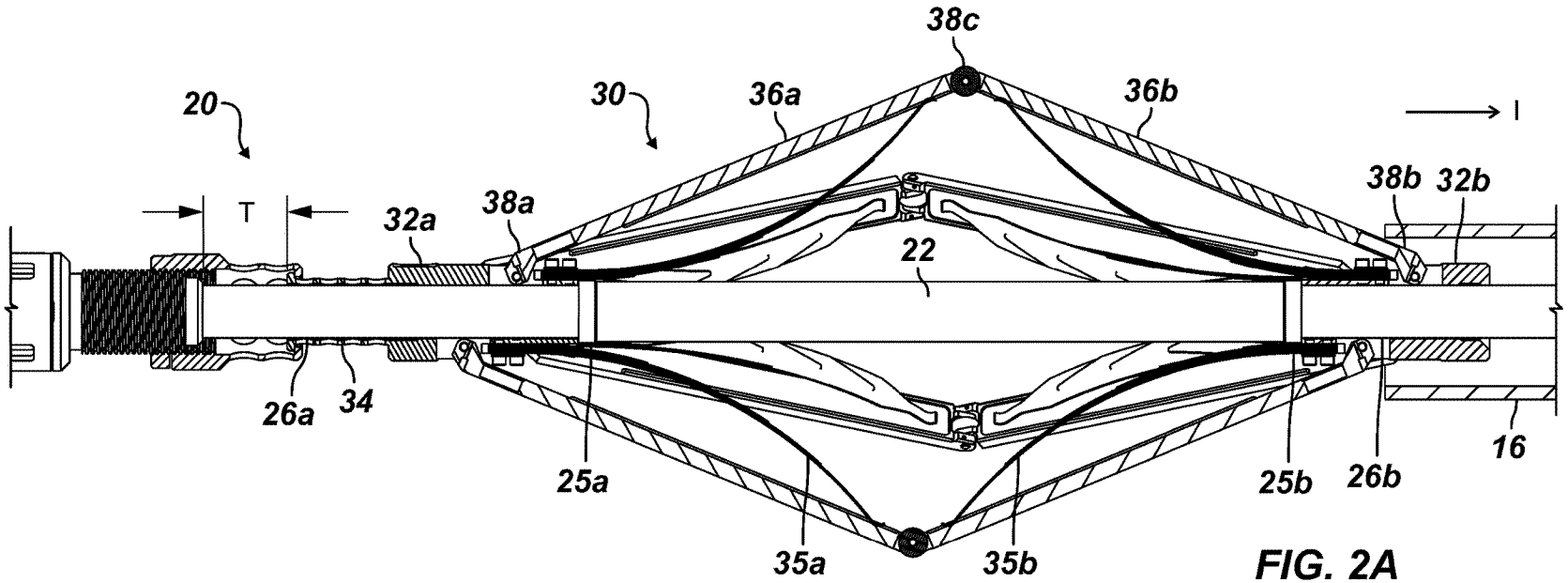
FIG. 2A (Prior Art)
FIGS. 2A-2B illustrate sectioned views of the conventional roller centralizer of the prior art in stages of movement.
Figure 2B:
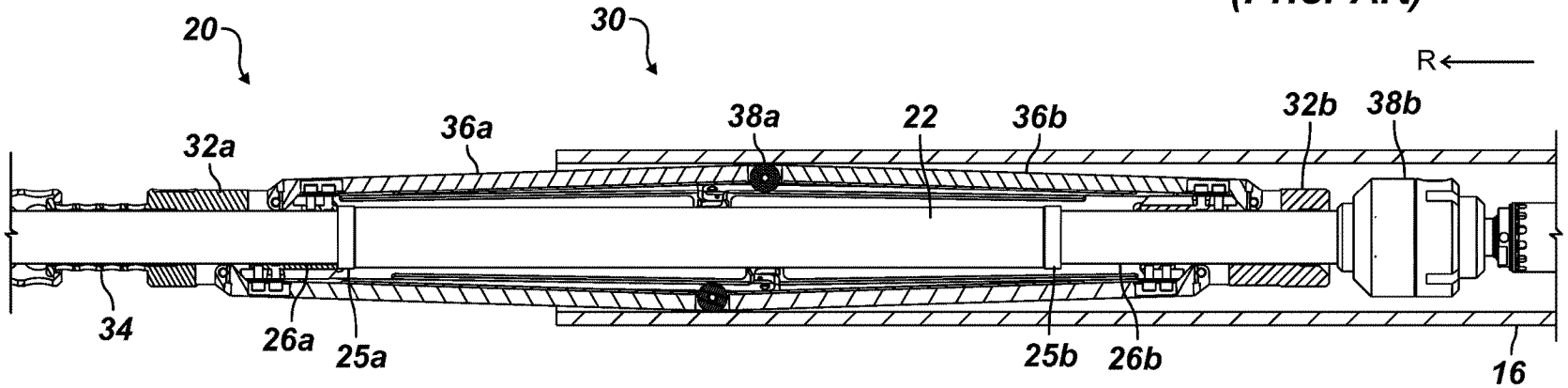
FIG. 2B (Prior Art)
Figure 3:
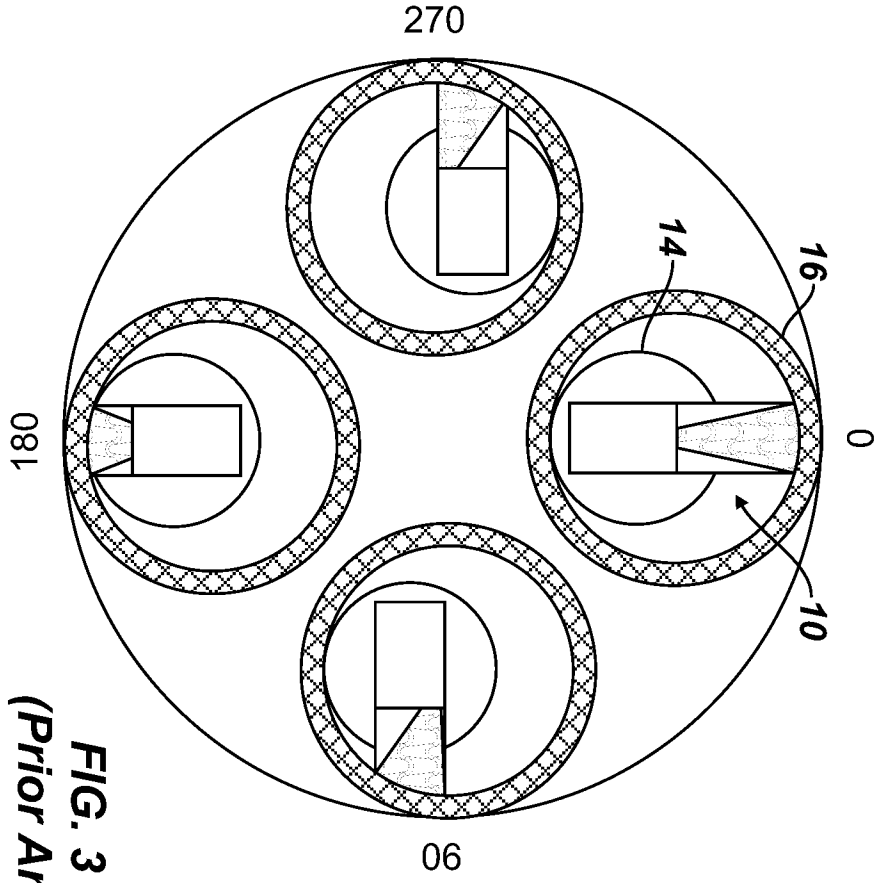
FIG. 3 (Prior Art)
FIG. 3 diagrams a sonde on a wireline tool at different decentralized orientations relative to surrounding casing.
Figure 4:
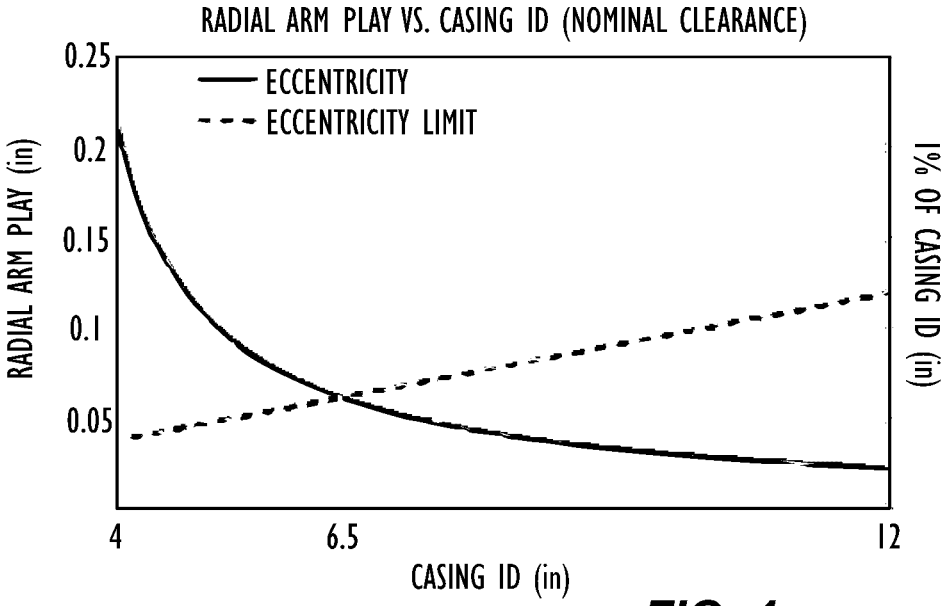
FIG. 4 (Prior Art)
FIG. 4 graphs eccentricity of the conventional roller centralizer as a function of inner casing diameters relative to radial arm play.
Figures 5A, 5B, 5C:
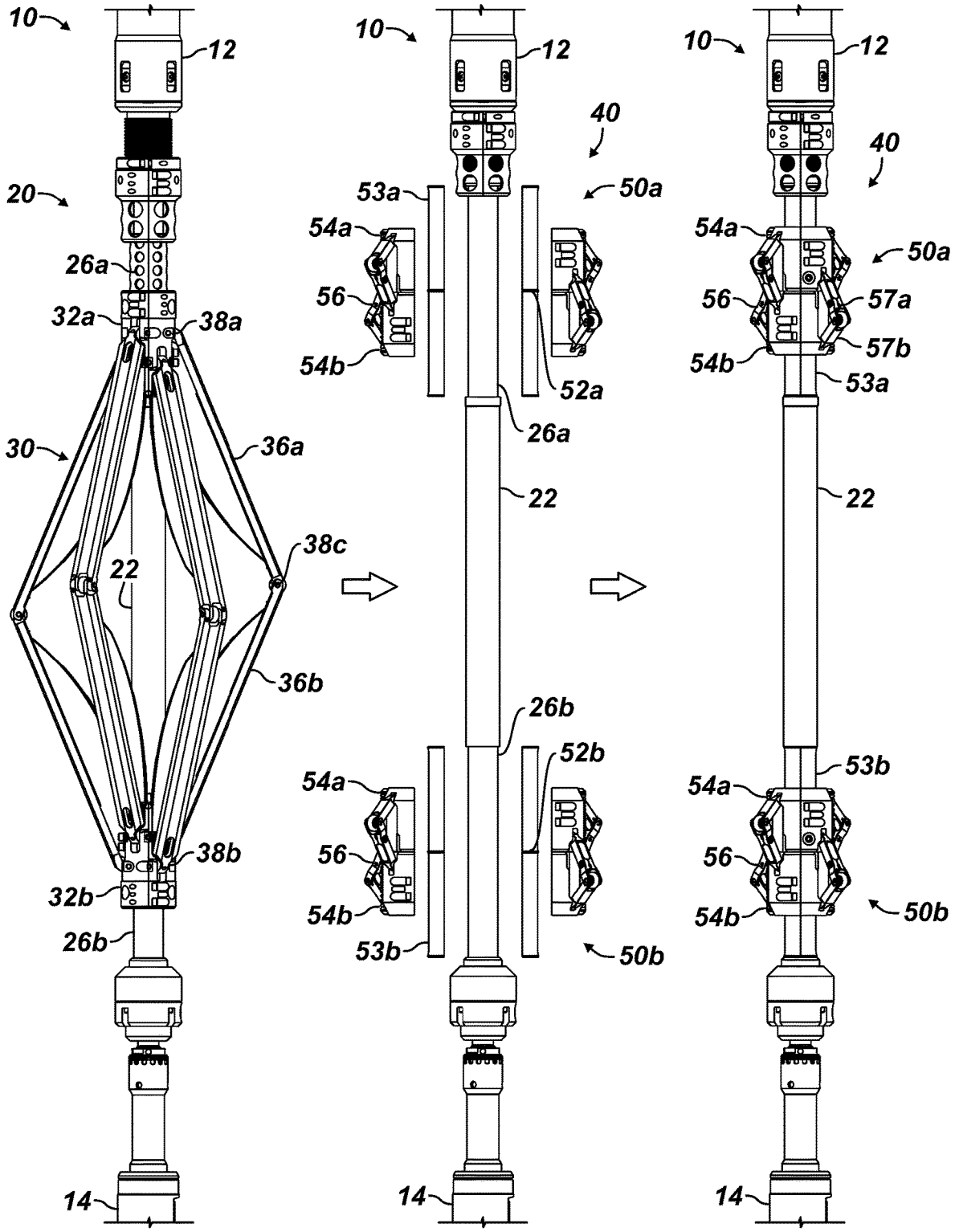
FIGS. 5A-5C illustrate elevational views of a portion of a wireline tool having a conventional roller centralizer of the prior art being replaced with a centralizer assembly of the present disclosure.

FIGS. 5A-5C illustrate elevational views of a portion of a wireline tool 10 having a conventional roller centralizer 20 of the prior art being replaced with a conversion centralizer assembly 40 of the present disclosure. In particular, the conversion centralizer assembly 40 shown in FIGS. 5B-5C is used for replacing components of the centralizer 20 of the wireline tool 10 shown in FIG. 5A so the tool 10 can be used with smaller diameter casing.

As noted above and shown again in FIG. 5A, the wireline tool 10 has the tool body 12 from which the existing centralizer 20 and sonde 14 extend. The centralizer 20 has the mandrel 22 connected at one end to the tool body 12, and the mandrel 22 supports the sonde 14 from its distal end. The mandrel 22 has the first and second recesses 26*a-b* separated by an upset having shoulders (25*a-b*).

The first and second slider blocks 32*a-b* of the conventional centralizer 20 are disposed respectively in the first and second recesses 26*a-b*, and the blocks 32*a-b* have a plurality of radial supports 30 interconnecting them. Each of the radial supports 30 has a first arm 36*a* hingedly connected at hinged connection 38*a* to the first slider block 32*a*, and each of the radial supports 30 has a second arm 36*b* hingedly connected at hinged connection 38*b* to the second slider block 32*b* and hingedly connected to the first arm 36*a* at a hinged connection 38*c*.

The conversion assembly 40 includes first and second centralizers 50*a-b* that replace the existing centralizer 20 on the mandrel 22. In converting the arrangement, the standard centralizer components are removed from the mandrel 22, and the two small casing centralizers 50*a-b* are installed completely within the slider block recesses 26*a-b* of the mandrel 22 to address the root problem of tool eccentricity. In general and as described below, the small casing centralizers 50*a-b* have small centralizer arms and compact form factors.

As shown in FIG. 5B, the first centralizer 50*a* has a first divider 52*a* disposed in the first recess 26*a* and has two slider blocks 54*a-b* disposed together in the first recess 26*a* on respective sides of the first divider 52*a*. The second centralizer 50*b* similarly has a second divider 52*b* disposed in the second recess 26*b* and has two slider blocks 54*a-b* disposed together in the second recess 26*b* on respective sides of the second divider 52*b*.

As shown in FIG. 5B for assembly purposes, each of the respective slider blocks 54*a-b* can include at least two pieces or halves fitting together in the respective recess 26*a-b* around the mandrel 22. Additionally, each of the first and second dividers 52*a-b* can include a sleeve 53*a-b* disposed in the respective recess 26*a-b*, with the sleeve 53*a-b* having a shoulder for the respective divider 52*a-b* and having the respective slider blocks 54*a-b* disposed on the sleeve 53*a-b* on opposing sides of the shoulder 52*a-b*. For assembly purposes, each of the sleeves 53*a-b* can include at least two pieces or halves fitting together in the respective recess 26*a-b* around the mandrel 22.

To do the conversion, for example, a set of sleeves 53*a-b* with the dividers or shoulders 52*a-b* integral to the sleeves 53*a-b* are installed onto the mandrel 22 in the recess 26*a-b* designed for the conventional centralizer (20). The blocks 54*a-b* for the two small form centralizers 50*a-b* are then installed where the single, larger centralizer blocks were previously installed.

For each centralizer 50*a-b*, a plurality of radial supports 56 are disposed between the slider blocks 54*a-b* around the mandrel 22. As shown in FIG. 5C, the supports 56 each include a first arm 57*a* hingedly connected to a first of the slider blocks 54*a* and include a second arm 57*b* hingedly connected to a second of the slider blocks 54*b*. The two arms 57*a-b* have their distal ends hingedly connected together at a joint, which has a roller.

With the centralizers 50*a-b* of the assembly 40 installed as shown in FIG. 5C in place of the conventional centralizer (20; FIG. 5A), the two centralizers 50*a-b* act to centralize the mandrel 22 and connected sonde 14 in smaller casing diameters without the considerable effective radial play (linkage slop) found in existing roller centralizers.

Figure 6A:
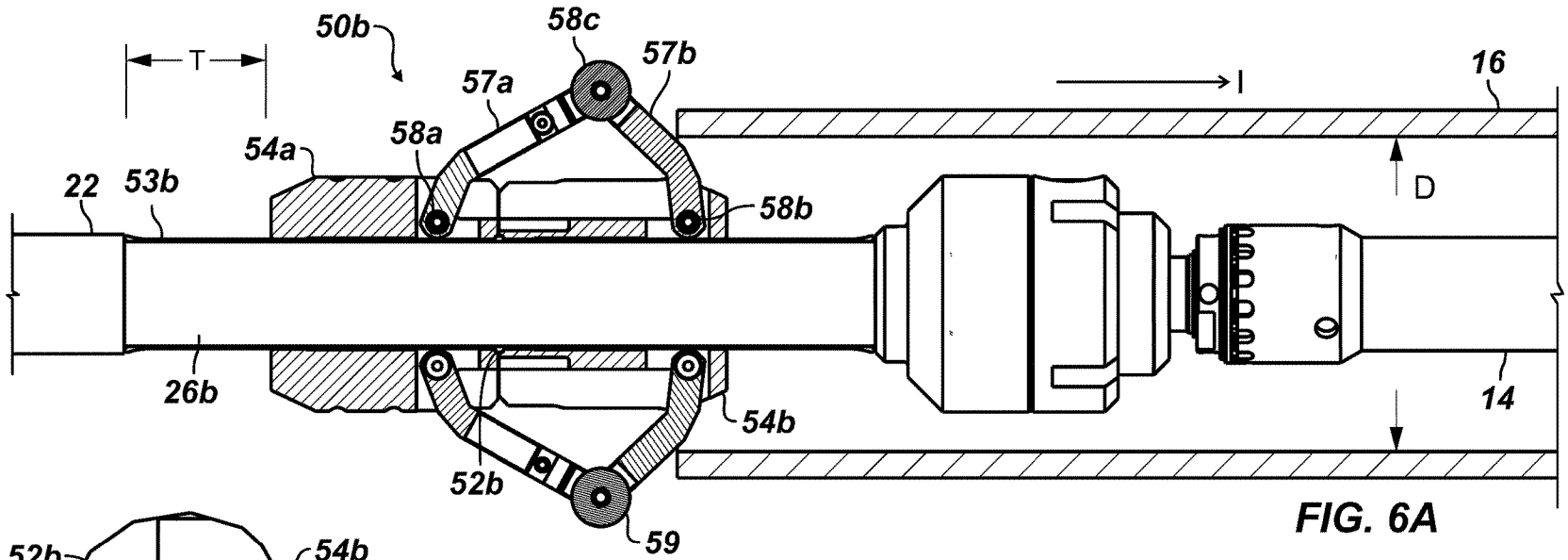
FIGS. 6A-6B illustrate sectioned views of one of the centralizers of the disclosed assembly in stages of movement.
Figure 6B:
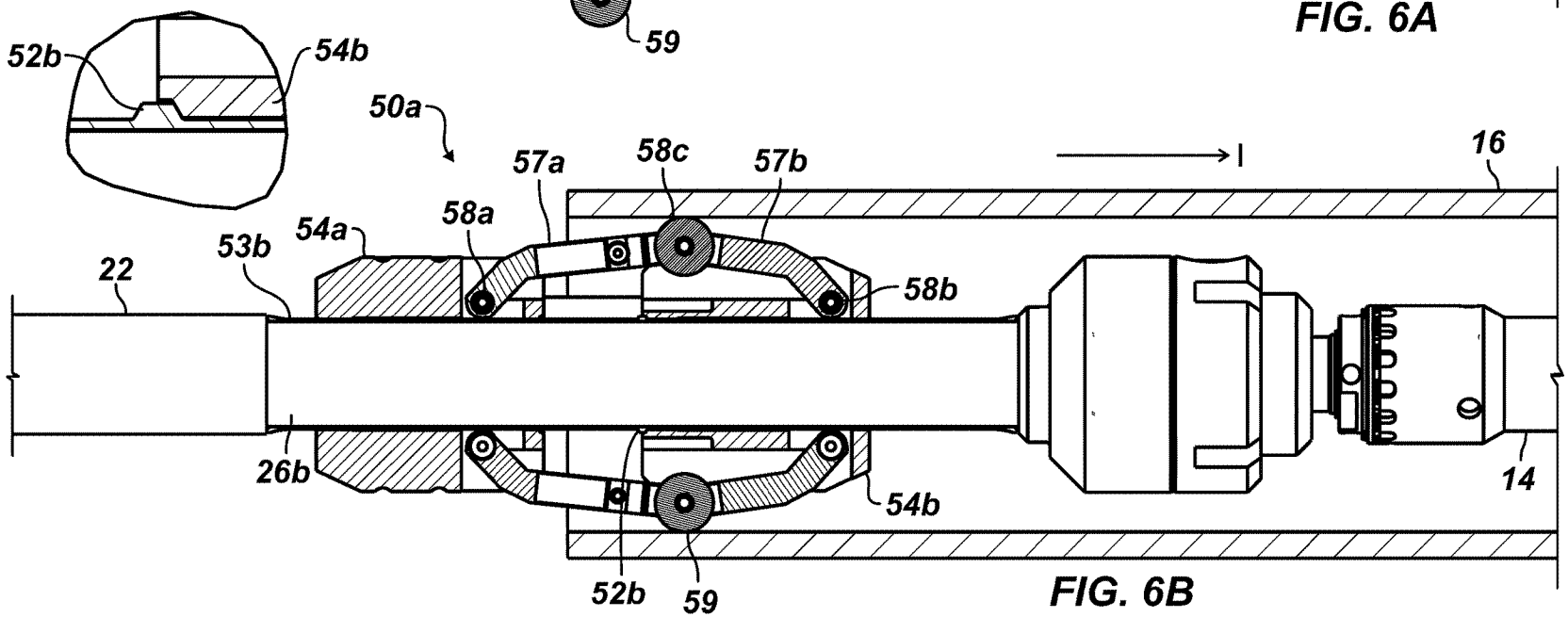

FIGS. 6A-6B illustrate sectioned views of one of the disclosed centralizers 50*b* in stages of movement, including insertion I into smaller diameter casing 16. Here, the distal centralizer 50*b* (i.e., the one near the sonde 14 on the distal end of the mandrel 22) is depicted. As shown in FIG. 6A, the slider blocks 54*a-b* with the centralizer 50*b* unrestricted can both shoulder against the divider 52*b* of the sleeve 53*b* in the recess 26*b*. When the distal arms 57*b* engage the casing 16, the distal block 54*b* as depicted in the detail stays shouldered against the divider 52*b*. A biasing arrangement, which is not shown here but is disclosed below, spaces out the proximal slider block 54*a*, which has an allowable travel T dictated by the sleeve/recess 53*b*/26*b*.

As shown, the intermediate hinged connection or joint 58*c* between the respective arms 57*a-b* includes a roller 59. Eventually on insertion as shown in FIG. 6B, the arms 56*a-b* retract inward as the proximal slider block 54*a* reaches the end of stroke, and the rollers 59 on the connected ends of the arms 56*a-b* engage inside the casing 16. The shouldering of the distal block 54*b* on the divider 52*b* ensures the proximal block 54*a* has adequate travel allowance for the maximum operating range of the centralizer 50*b*. (As will be appreciated, the centralizer 50*b* must also have adequate block travel in both proximal and distal locations to prevent getting stuck. Moreover, the proximal centralizer 50*a* of the assembly 40 can be comparably configured and arranged.)

In one example, the length for the recess 26*b* as modified by the sleeve 53*b* can be about 10.75-in. The small casing centralizer 50*b* can fully collapse into casing 16 having an inner diameter of 4.5-in with additional clearance available. The arm angles can be limited to 15° at a 4-in inner casing diameter, and the radial arm play at the 4-in inner casing diameter can be reduced by 87%. (Again, the proximal centralizer 50*a* of the assembly 40 can be comparably configured and arranged.)

Figure 7A:
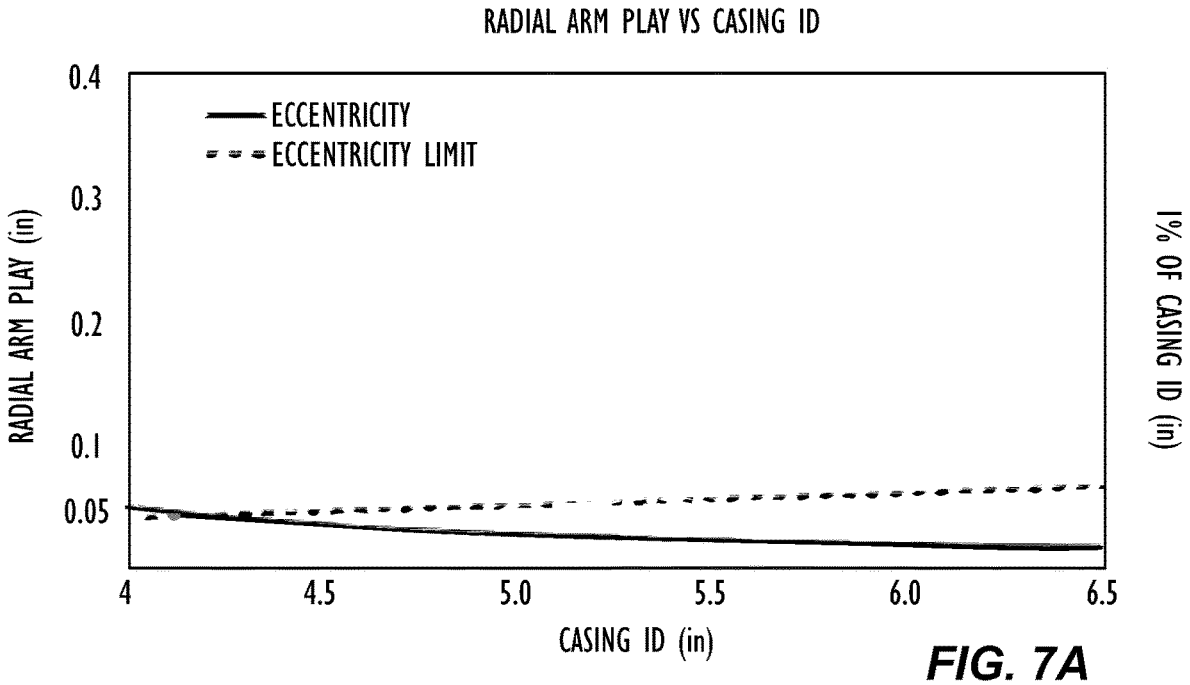
FIG. 7A graphs eccentricity of the disclosed centralizer as a function of inner casing diameters relative to radial arm play.

For example, FIG. 7A graphs eccentricity of a disclosed centralizer (50*a-b*) as a function of inner casing diameters relative to radial arm play. Radial arm play for an inner casing diameter of 6.5-in may be well less than 0.05 in, and the radial arm play may only increase to about 0.05-in for an inner casing diameter of 4-in. For some wireline tools, the eccentricity has a preferred limit, such as a limit of 1% eccentricity of the inner casing diameter depicted by the dashed line in the graph. As can be seen, the eccentricity from the radial arm play does not exceed the preferred limit until the inner casing diameter reaches as low as 4-in.

Figure 7B:
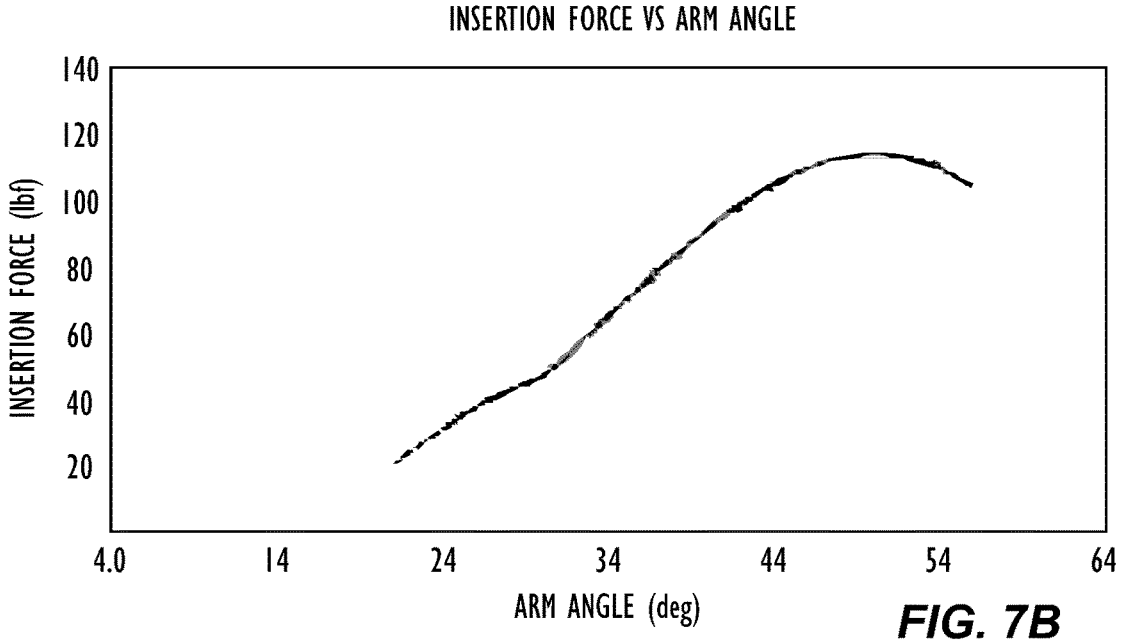
FIG. 7B graphs insertion force relative to the arm angle of the disclosed centralizer.

In addition, the insertion force required to insert the centralizer (50*a-b*) can be reduced. For example, FIG. 7B graphs insertion force relative to the arm angle on the disclosed centralizer (50*a-b*). The insertion force of the centralizer (50*a-b*) can be reduced to below 120-lbf, which is a reduction of more than 90% from the insertion force required of the conventional roller centralizer.

Figure 8B:
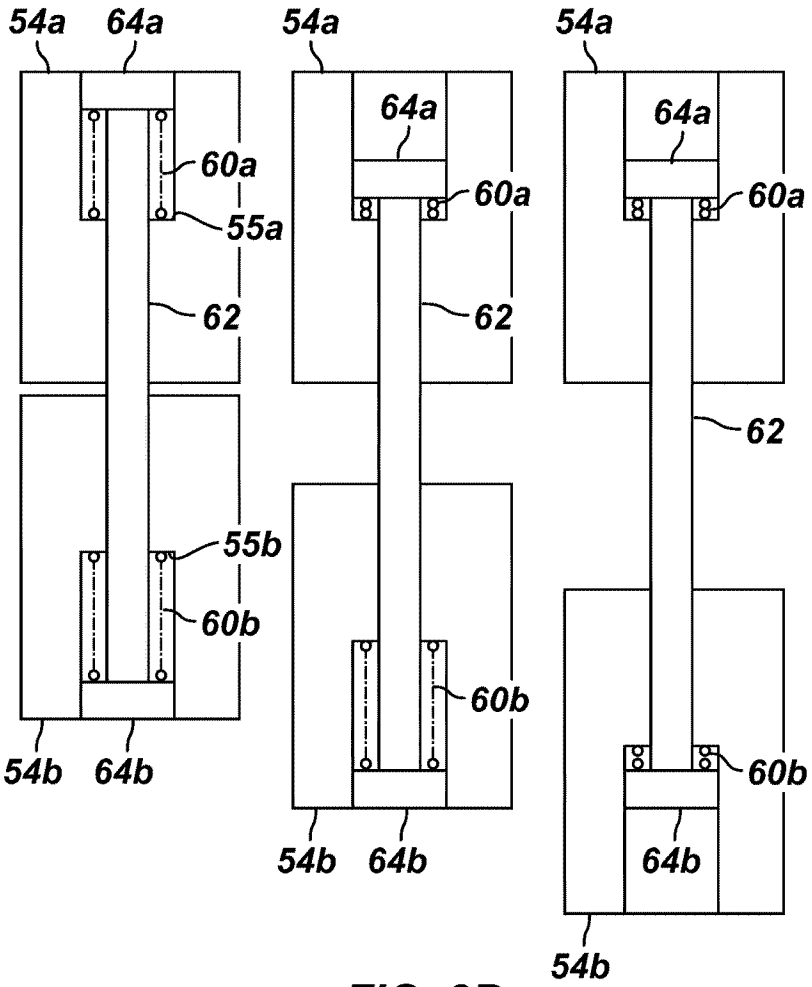
FIG. 8B illustrates schematic views of another biasing arrangement for the disclosed centralizer during operation.

To further address the centralizing force profile over the range of casing sizes, a biasing arrangement of the disclosed centralizer 50*a-b* houses biasing elements between the slider blocks 52*a-b*. In particular, FIGS. 8A-8B illustrate schematic views of biasing arrangements for the disclosed centralizer (50*a-b*) during operation.

Figure 8A:
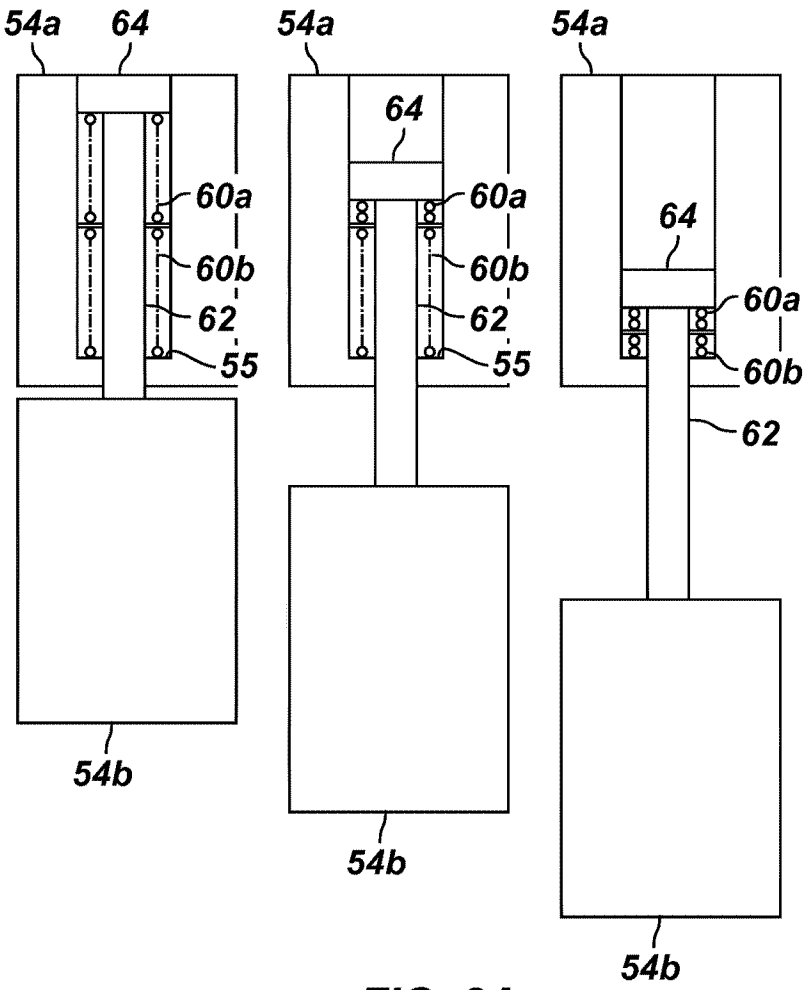
FIG. 8A illustrates schematic views of one biasing arrangement for the disclosed centralizer during operation.

In FIG. 8A, the two slider blocks 54*a-b* of one of the centralizers (50*a-b*) are disposed adjacent one another. (Arms of the radial supports are not shown between the blocks 54*a-b* for simplicity.) One (e.g., distal) slider block 54*b* has a pin 62 connected thereto, which passes to the other (proximal) slider block 54*a*. First and second biasing elements 60*a-b* are stacked in series on the pin 62 between a pin shoulder 64 and a block shoulder 55.

As noted, engagement of the arms (not shown) with the casing wall urges or pushes the blocks apart relative to any dividing upset. In general, one of the biasing elements (e.g., 60*a*) biases an initial extent of separation between the first and second slider blocks 54*a-b*, while the other biasing element (e.g., 60*b*) biases a subsequent extent of the separation between the first and second slider blocks 54*a-b*. For example, one of the biasing elements (e.g., 60*a*) has a lighter/heavier stiffness than the other biasing element (60*b*), and/or one of the biasing elements (e.g., 60*a*) has a longer/shorter travel distance than the other biasing element (60*b*).

With separation of the slider blocks 54*a-b*, for instance, the first biasing element 60*a* biases the initial extent of the separation until the biasing element 60*a* shoulders or reaches stack length, as shown in the intermediate state. With further separation of the slider blocks 54*a-b*, the second biasing element 60*b* then biases the subsequent extent of the separation until the second biasing element 60*b* shoulders or reaches stack length, as shown in the final state.

In the arrangement of FIG. 8B, a common pin 62 passes through the adjacent slider blocks 54*a-b*. A first biasing elements 60*a* is stacked on the pin 62 between a first pin shoulder 64*a* and a first block shoulder 55*a*. A second biasing elements 60*b* is stacked on the pin 62 between a second pin shoulder 64*b* and a second block shoulder 55*b*.

In general, one of the biasing elements (e.g., 60*a*) biases an initial extent of separation between the first and second slider blocks 54*a-b*, while the other biasing element (e.g., 60*b*) biases a subsequent extent of the separation between the first and second slider blocks 54*a-b*. For example, one of the biasing elements (e.g., 60*a*) has a lighter/heavier stiffness than the other biasing element (60*b*), and/or one of the biasing elements (e.g., 60*a*) has a longer/shorter travel distance than the other biasing element (60*b*).

With separation of the slider blocks 54*a-b*, for instance, the first biasing element 60*a* biases the initial extent of the separation until the biasing element 60*a* shoulders or reaches stack length, as shown in the intermediate state. With further separation of the slider blocks 54*a-b*, the second biasing element 60*b* then biases the subsequent extent of the separation until the second biasing element 60*b* shoulders or reaches stack length, as shown in the final state.

Figure 9A:
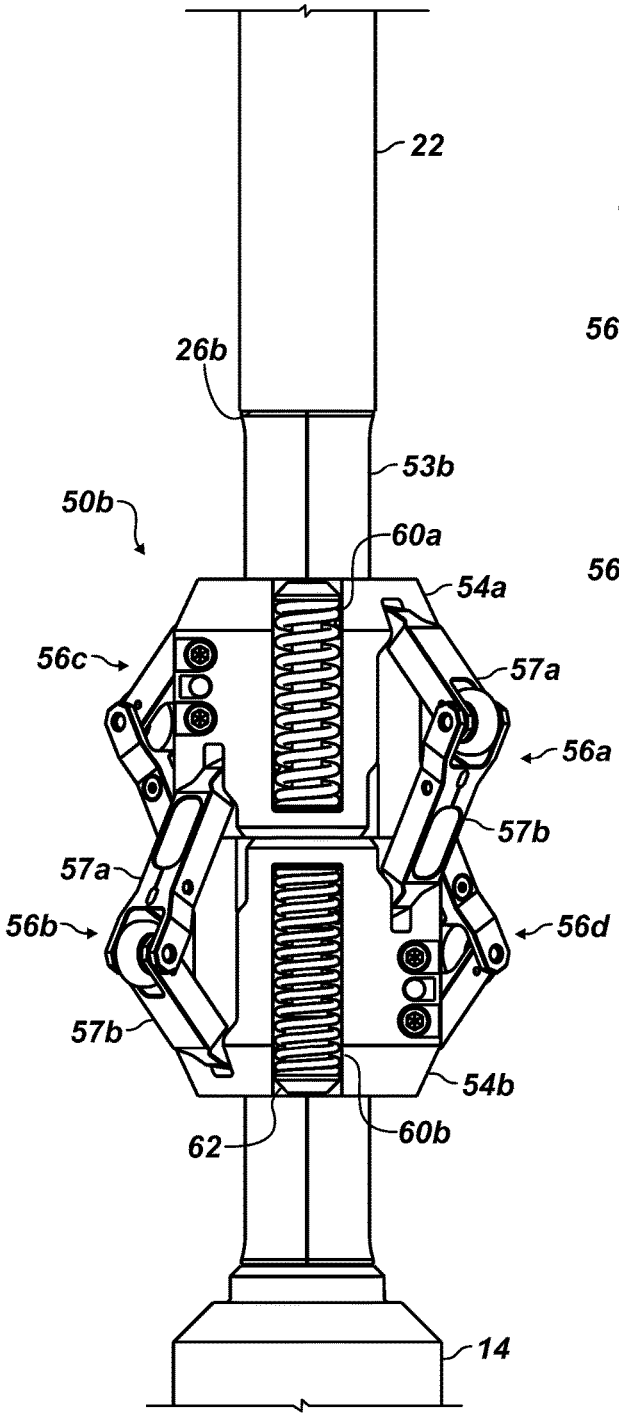
FIGS. 9A-9B illustrate elevational views of the centralizers of the present disclosure, revealing features of their biasing elements.
Figure 9B:
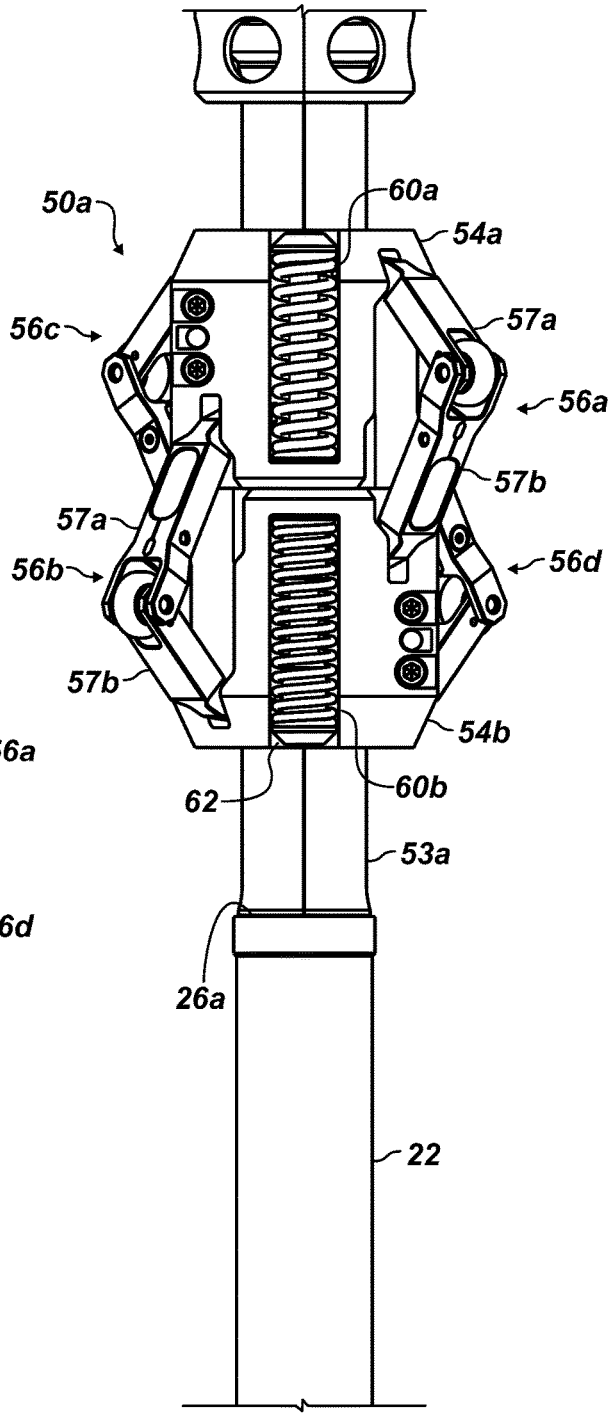

Using the second biasing arrangement disclosed above with reference to FIG. 8B, FIGS. 9A-9B illustrate elevational views of the centralizers 50*a-b* of the present disclosure, revealing features of biasing elements or springs 60*a-b* used with the slider blocks 54*a-b*. The centralizers 50*a-b* are each arranged with the proximal slider block 54*a* having a first biasing element 60*a* and with the distal slider block 54*b* having a second biasing element 60*b* on the common pin 62. Thus, the biasing arrangement is the same for both centralizers 50*a-b* on the mandrel 22, but other configurations could be used.

As also shown in FIGS. 9A-9B, the centralizers 50*a-b* each preferably has a plurality of radial supports 56 disposed about the slider blocks 54*a-b*. The radial supports 56 are arranged about the slider blocks 54*a-b* in an alternating and opposing pattern. For example, the first arm 57*a* of one support 56*a* is connected closer to the outer edge of the proximal slider block 54*a*, whereas the second arm 57*b* of the support 56*a* is connected closer to the inner edge of the distal slider block 54*b*. The adjacent support 56*b* is arranged in opposing relation. Namely, the first arm 57*a* is connected closer to the inner edge of the proximal slider block 54*a*, whereas the second arm 57*b* is connected closer to the outer edge of the distal slider block 54*b*. The first and second arms 57*a-b* may have the same or different lengths. This pattern is repeated uniformly about the slider blocks 54*a-b* such that there are a plurality of alternating supports 56*a-d* disposed about the mandrel 22. As shown here, four supports 56*a-d* may be provided, and the two centralizers 50*a-b* may be comparably arranged.

FIGS. 10A-10B, 11A-11B, and 12A-12B illustrate sections views of one of the disclosed centralizer 50 of the present disclosure, revealing additional features of the biasing elements or springs 60*a-b* in different stages of movement. Here, the centralizer 50 depicted is the distal centralizer 50*b* closer to the sonde (14).

Figure 10A:
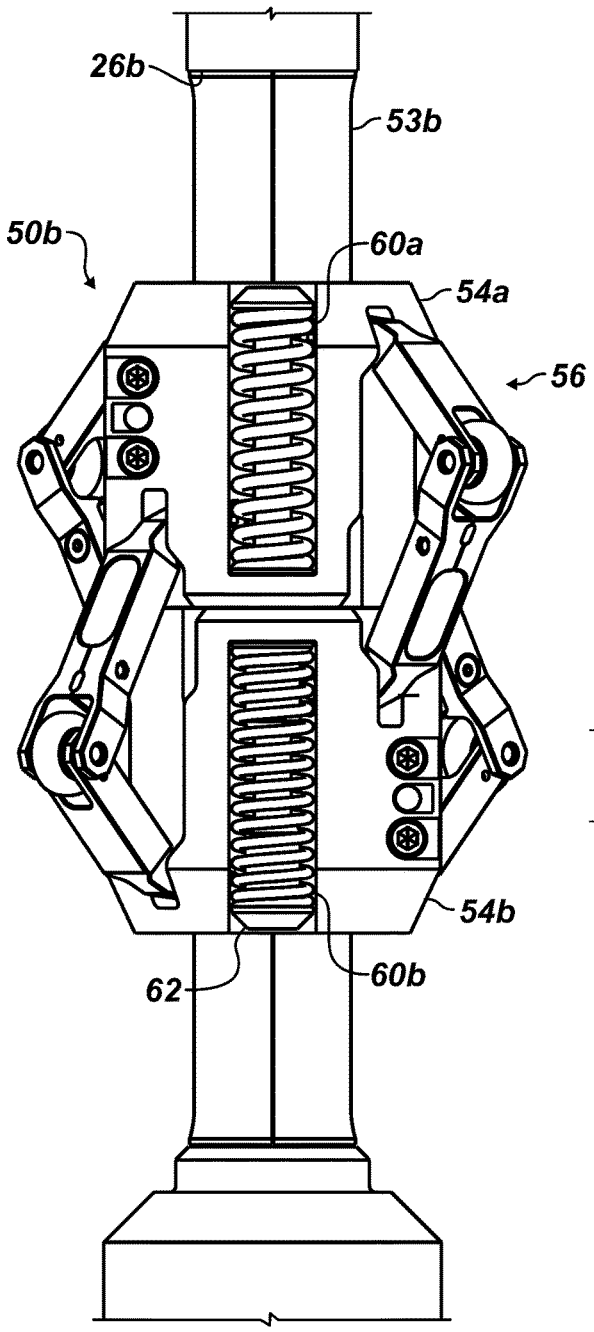
FIGS. 10A-10B illustrate sectioned views of one of the disclosed centralizers of the present disclosure, revealing additional features of the biasing elements in different stages of movement.
Figure 10B:
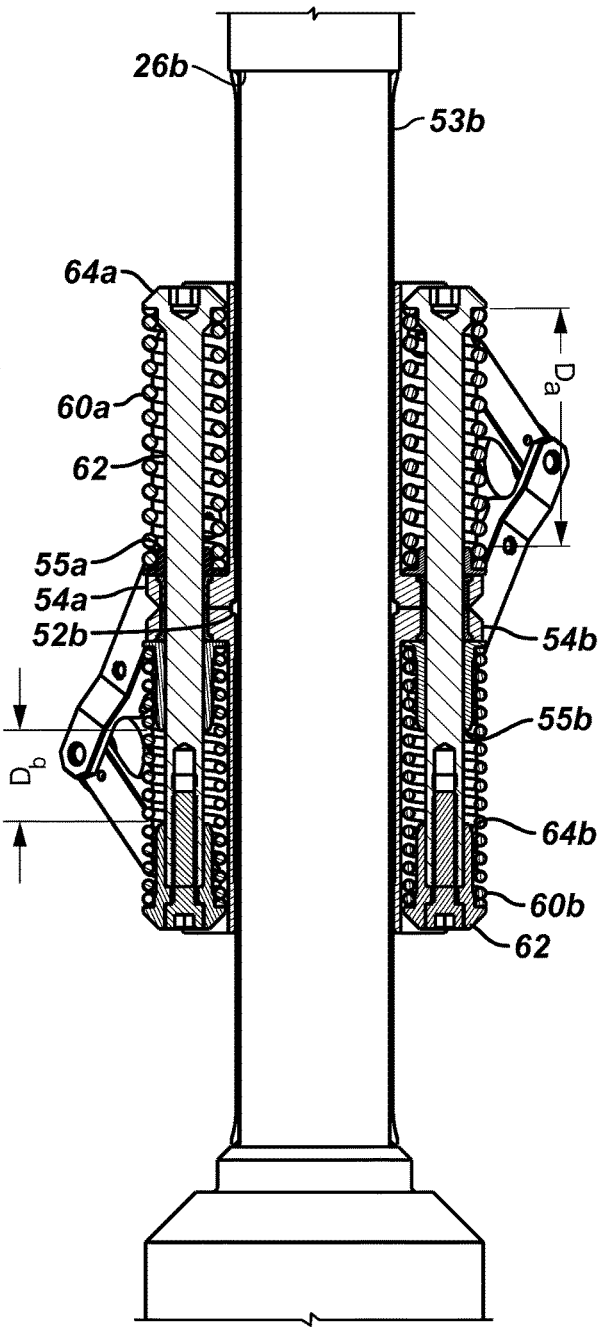

As shown in FIGS. 10A-10B, the respective slider blocks 54*a-b* for the centralizer 50*b* include a common pin or guide rod 62 disposed through adjacent shoulders 55*a-b* on the respective slider blocks 54*a-b*. The common pin 60 has a first (proximal) shoulder end 64*a* and has a first biasing element 60*a* disposed on the common pin 62 between the first shoulder end 64*a* and a first of the adjacent shoulders 55*a*. The common pin 62 also has a second (distal) shoulder end 64*b* and has a second biasing element 60*b* disposed on the common pin 62 between the second shoulder end 64*b* and a second of the adjacent shoulders 55*b*.

The first biasing element 60*a* has a first stiffnesses, and the second biasing element 60*b* has a second stiffness different from the first stiffness. For this distal centralizer 50*b*, the proximal biasing element 60*a* is a heavy spring, and the distal biasing elements 60*b* is a light spring with less stiffness.

Additionally, a first shouldering distance $D_a$ between the proximal end 64*a* of the common pin 60*a* and the first adjacent shoulder 55*a* (for the heavy spring 60*a*) is greater than a second shouldering distance $D_b$ between the distal end 64*b* of the common pin 62 and the second adjacent shoulder 55*b* (for the light spring 60*b*). As will be appreciated, the respective spring 60*a-b* may have a stack length less than the shouldering distance. This is true, for example, with the heavy spring 60*a*.

Figure 11A:
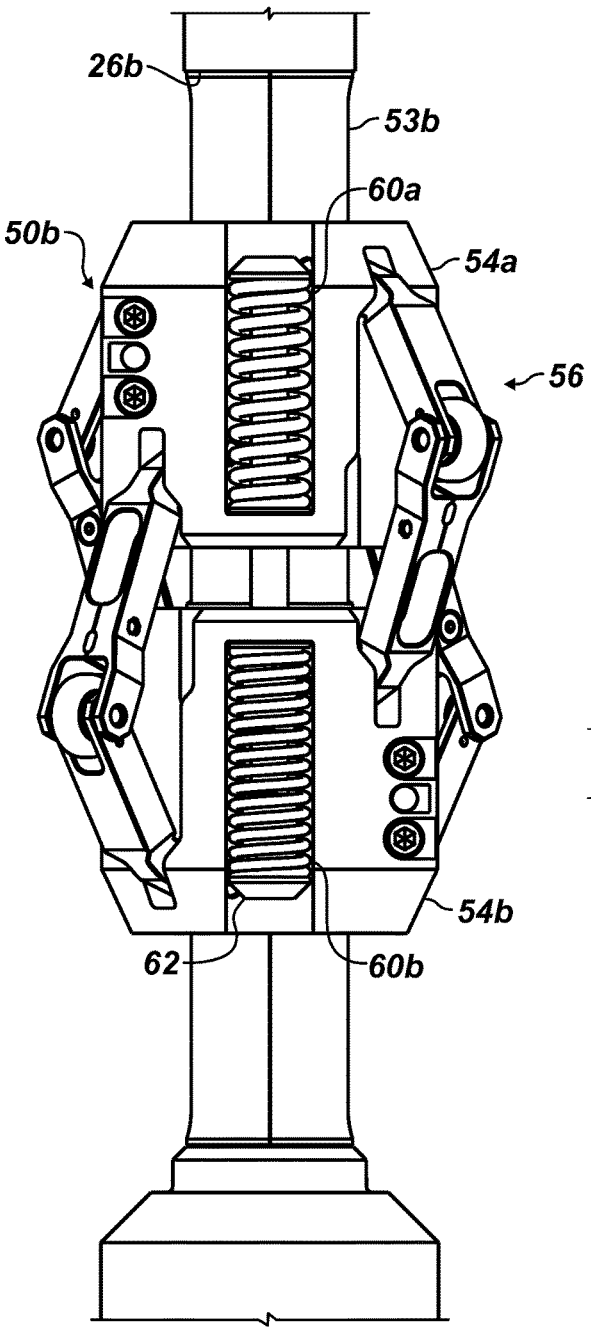
FIGS. 11A-11B illustrate sectioned views of the disclosed centralizer in a biased state.
Figure 11B:
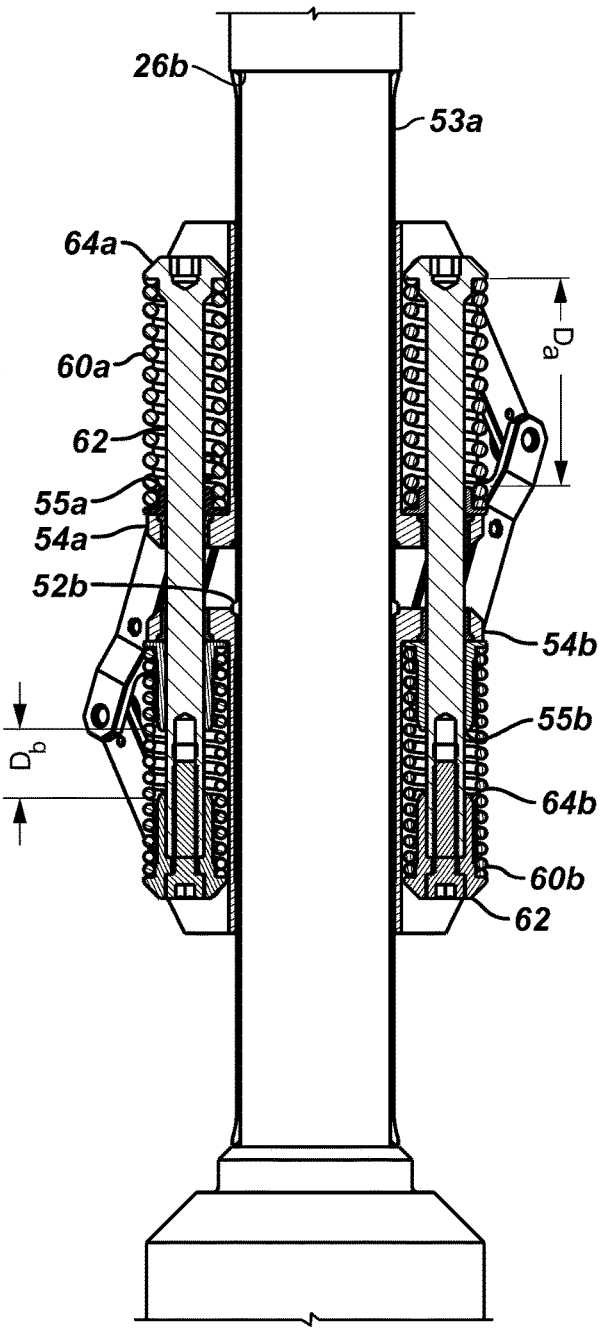

When the centralizer 50*b* is unengaged as shown in FIGS. 10A-10B, the biasing elements 60*a-b* on the common pin 62 bring the slider blocks 54*a-b* together toward the divider 52*b*. During engagement of the arms 56*a-b* with casing (not shown), the biasing elements 60*a-b* are compressed by the slider blocks 54*a-b* moving apart from one another through the linkage of the arms 56*a-b*. FIGS. 11A-11B show the slider blocks 54*a-b* during a state of moving apart.

When used in larger casing diameters, both biasing elements 60*a-b* active and result in an effective spring constant that produces an adequate centralizing force. As the angle of the centralizing arms 56*a-b* becomes smaller when used in small casing, however, the centralizing load becomes smaller so it is desirable to increase the spring stiffness at small casing sizes. This increased spring stiffness at smaller casing sizes is accomplished here using the short shouldering distance $D_b$ between the spring stops 55*b*, 64*b* for the second biasing element or light spring 60*b*.

Figure 12A:
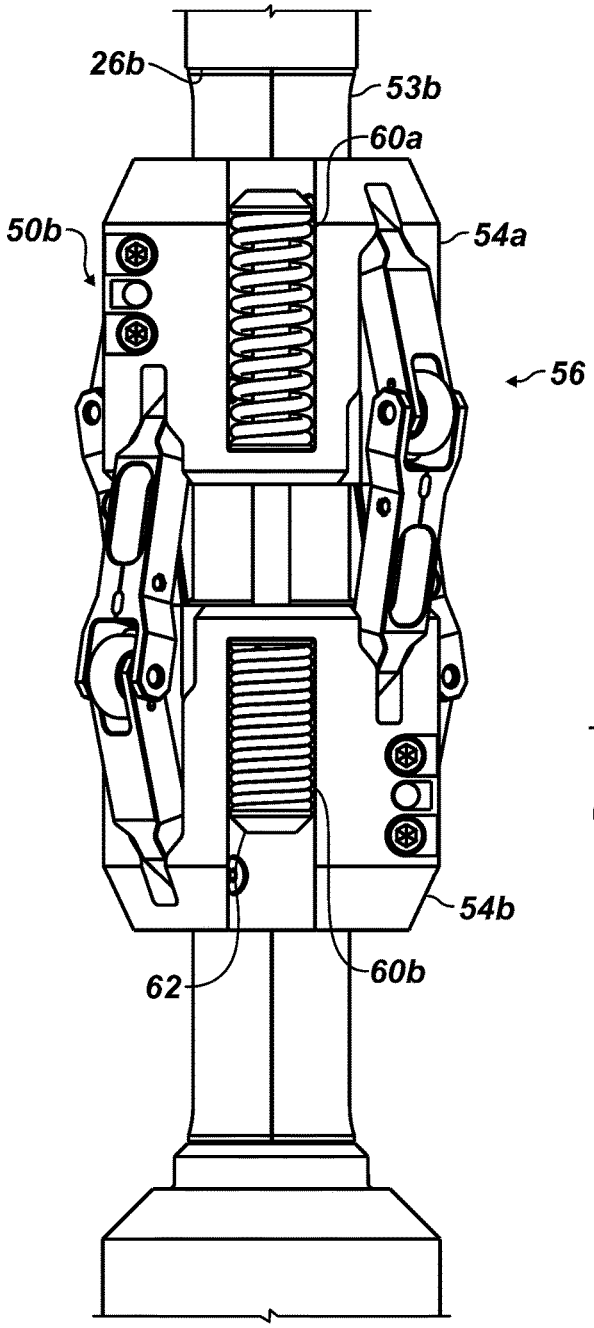
FIGS. 12A-12B illustrate sectioned views of the disclosed centralizer in another biased state.
Figure 12B:
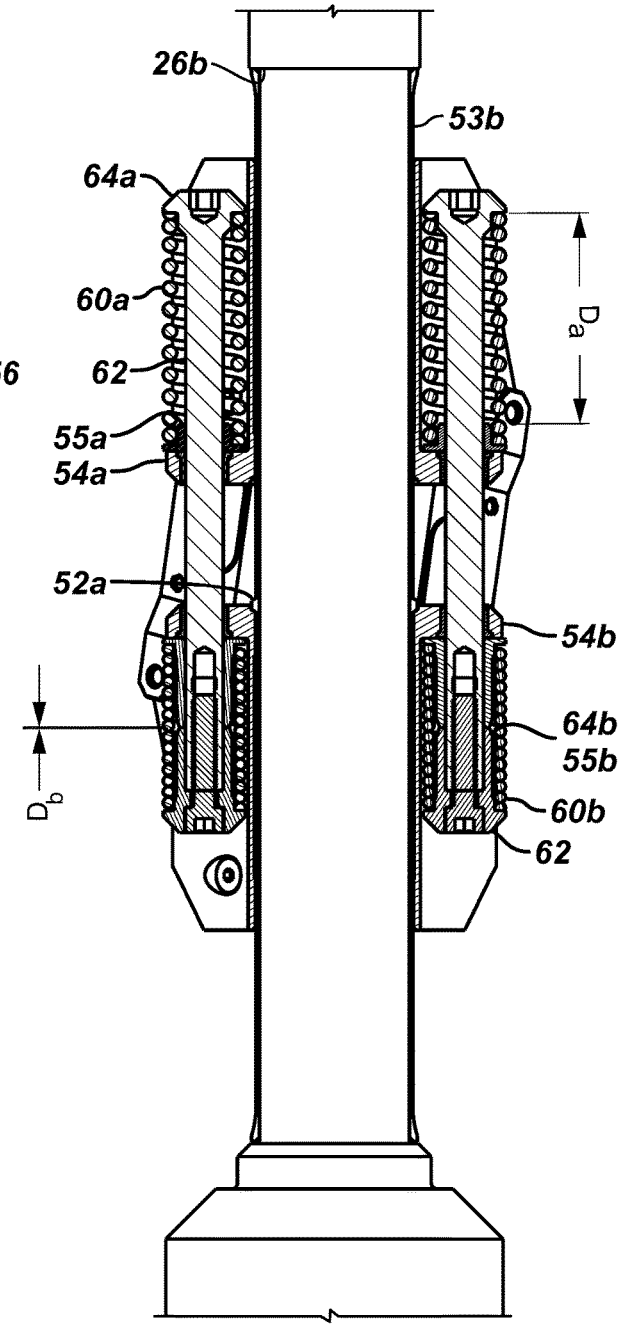

In particular, FIGS. 12A-12B show the centralizer 50*b* compressed to an even smaller casing size. As shown, the spring stops 55*b*, 64*b* prevent the light spring 60*b* from compressing further as the short shouldering distance $D_b$ closes. This changes the effective spring rate to the stiffer spring 60*a* and dramatically increases the centralizing force for the smaller casing range.

As will be appreciated, the proximal centralizer (50*a*) for the assembly (40) can be comparably arranged and configured as the distal centralizer 50*b* depicted here. As can be seen, the biasing arrangement uses a two-stage series spring assembly that varies the effective spring constant using two distinct spring constants. The mechanical advantage and spring constants of the disclosed arrangement act to level out the centralizer's side force profile over the entire range of casing sizes in which the centralizer 50*a-b* is intended for use. This is in direct contrast to the conventional type of biasing arrangement, such as found on a centralizer of the prior art.

Figure 13A:
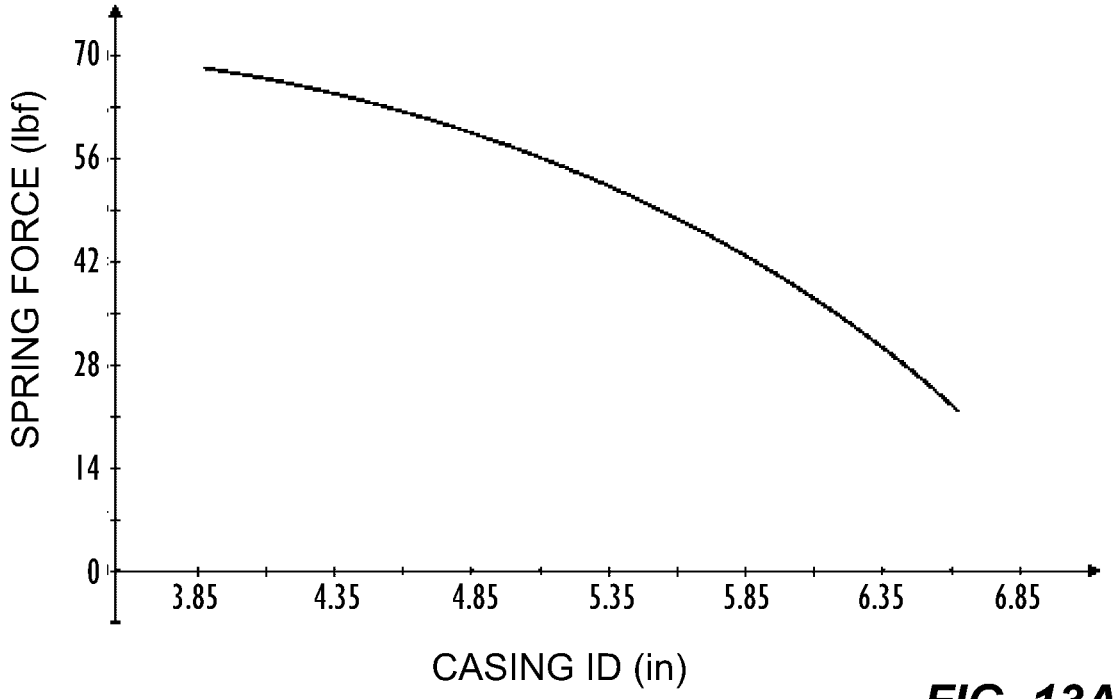
FIG. 13A (Prior Art)
FIG. 13A graphs spring force relative to inner casing diameters for a conventional type of biasing arrangement of a prior art roller centralizer.
Figure 13B:
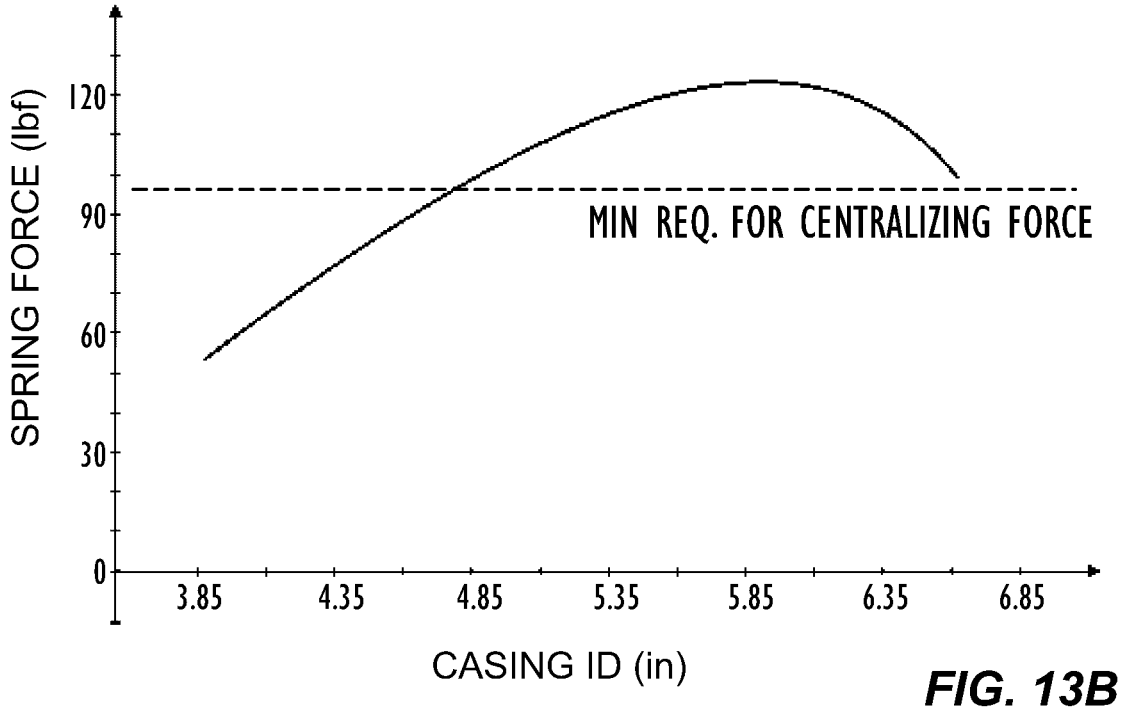
FIG. 13B (Prior Art)
FIG. 13B graphs centralizing force relative to inner casing diameters for the conventional type of biasing arrangement.

For example, FIG. 13A graphs spring force relative to inner casing diameters for a conventional type of biasing arrangement for a centralizer of the prior art. As the centralizer arms are compressed into smaller diameter casing, the conventional spring assembly compresses with increasing spring force. However, due to increasing mechanical advantage as the centralizer's arm angle decreases in the smaller casing ID, the resulting centralizing force is very small. For example, FIG. 13B graphs the centralizing force relative to inner casing diameters for the conventional type of centralizer assembly. As seen here, the centralizing force dips below a required force and allows the tool to be eccentric in the casing.

Figure 14A:
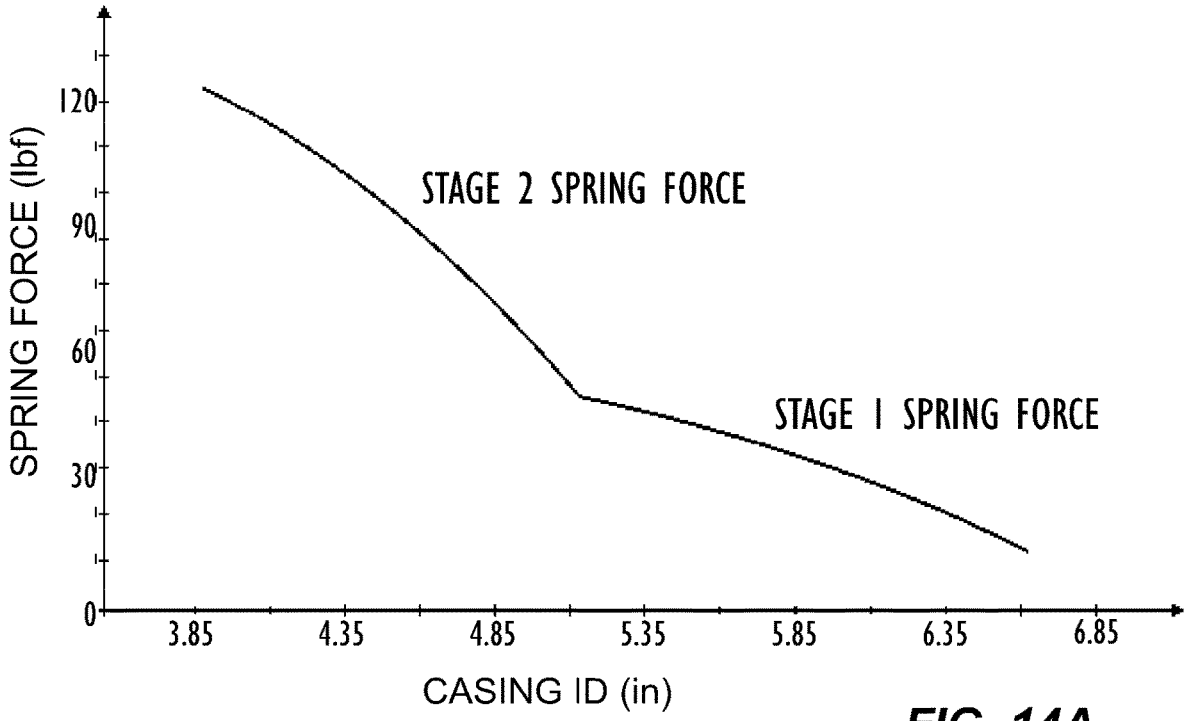
FIG. 14A graphs spring force relative to inner casing diameters for the disclosed biasing arrangement.

In contrast to the conventional biasing arrangement, the disclosed biasing arrangement offers two-stage biasing. For example, FIG. 14A graphs spring force relative to inner casing diameters for the biasing arrangement of the present disclosure. A first stage applies to larger casing sizes (e.g., about 5.2-in and above), both springs 60*a-b* are engaged, and the effective spring constant is low. In a second stage at small casing sizes (e.g., below about 5.2-in), only one spring 60*a* (with a higher spring constant) is engaged, making the spring constant high. Thus, the first stage produces a low spring constant with low mechanical advantage, and the second stage provides a high spring constant with high mechanical advantage. These act to level out the centralizer's side force profile over the entire range of casing sizes for which the centralizers (50*a-b*) are intended.

Figure 14B:
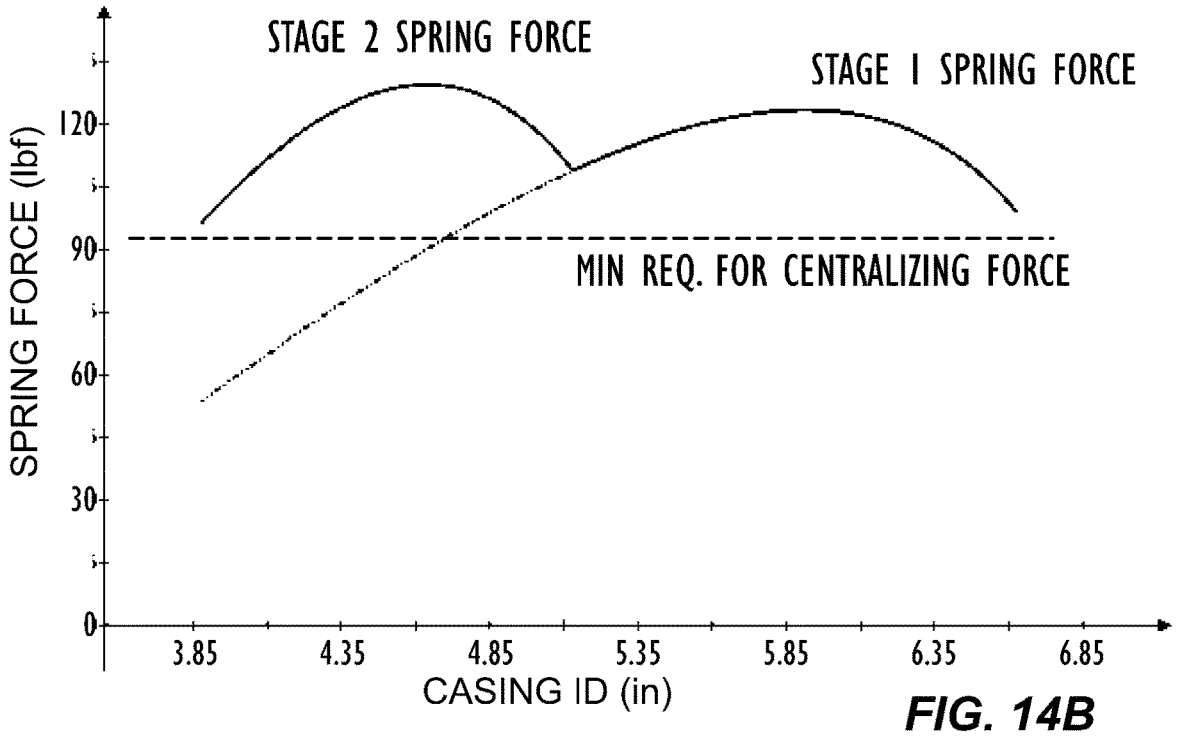
FIG. 14B graphs centralizing force relative to inner casing diameters for the disclosed biasing arrangement.

In particular, FIG. 14B graphs centralizing force relative to inner casing diameters for the biasing arrangement of the present disclosure. As noted above, there is a minimum requirement for the centralizing force of the centralizer to keep the tool centered. The resulting centralizing forces in the two stages give the centralizer an overall centralizing force above the minimum requirement.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly for converting a given centralizer of a wireline tool for use with smaller diameter casing, the wireline tool having a mandrel with first and second recesses separated by an upset, the given centralizer having first and second slider blocks disposed respectively in the first and second recesses and having a plurality of given radial supports, each of the given radial supports having a first arm hingedly connected to the first slider block, each of the radial supports having a second arm hingedly connected to the second slider block and hingedly connected to the first arm, the assembly comprising:

first and second centralizers replacing the given centralizer on the mandrel, the first centralizer having a first divider disposed in the first recess and having third and fourth slider blocks disposed together in the first recess on respective sides of the first divider, the first centralizer having a third arm hingedly connected to the third slider block, the first centralizer having a fourth arm hingedly connected to the fourth slider block and hingedly connected to the third arm; and the second centralizer having a second divider disposed in the second recess and having fifth and sixth slider blocks disposed together in the second recess on respective sides of the second divider, the second centralizer having a fifth arm hingedly connected to the fifth slider block, the second centralizer having a sixth arm hingedly connected to the sixth slider block and hingedly connected to the fifth arm.

2. The assembly of claim 1, wherein each of the respective slider blocks comprises at least two pieces fitting together in the respective recess around the mandrel.

3. The assembly of claim 1, wherein each of the first and second dividers comprises a sleeve disposed in the respective recess, the sleeve having a shoulder for the respective divider and having the respective slider blocks disposed on the sleeve on opposing sides of the shoulder.

4. The assembly of claim 3, wherein each of the sleeves comprises at least two pieces fitting together in the respective recess around the mandrel.

5. The assembly of claim 1, wherein each of the respective slider blocks for the first and second centralizers comprises a common pin disposed through adjacent shoulders on the respective slider blocks, the common pin having a first shoulder end and having a first biasing element disposed on the common pin between the first shoulder end and a first of the adjacent shoulders, the common pin having a second shoulder end and having a second biasing element disposed on the common pin between the second shoulder end and a second of the adjacent shoulders.

6. The assembly of claim 5, wherein the first biasing element comprises a first stiffnesses; and wherein the second biasing element comprises a second stiffness different from the first stiffness.

7. The assembly of claim 5, wherein a first shouldering distance between the first end of the common pin and the first adjacent shoulder is greater than a second shouldering distance between the second end of the common pin and the second adjacent shoulder.

8. The assembly of claim 1, wherein the first centralizer comprises a plurality of first radial supports, each of the first radial supports having a set of the third and fourth arms; and wherein the second centralizer comprises a plurality of second radial supports, each of the second radial supports having a set of the fifth and sixth arms.

9. The assembly of claim 8, wherein the first radial supports are arranged about the third and fourth slider blocks alternatingly closer to edges of the third and fourth slider blocks.

10. A centralizer for use on a wireline tool in casing having a number of inner diameters, the wireline tool having a mandrel with a dividing upset, the centralizer comprising:

a first slider block disposed on the mandrel on a first side of the dividing upset;

a second slider block disposed on the mandrel on a second side of the dividing upset, the first and second slider blocks being separable from one another;

a first arm hingedly connected to the first slider block;

a second arm hingedly connected to the second slider block and hingedly connected to the first arm;

a common pin disposed between the first and second slider blocks;

a first biasing element arranged between the common pin and at least one of the first and second slider blocks; and a second biasing element arranged between the common pin and at least one of the first and second slider blocks, the first biasing element being configured to bias the common pin and the at least one of the first and second slider blocks for an initial extent of separation between the first and second slider bocks, the second biasing element being configured to bias the common pin and the at least one of the first and second slider blocks for a subsequent extent of the separation between the first and second slider bocks.

11. The centralizer of claim 10, wherein the first slider block comprises a first shoulder facing away from the dividing upset;

wherein the second slider block comprises a second shoulder facing away from the dividing upset;

wherein the common pin is disposed through the first and second shoulders on the respective slider blocks, the common pin having third and fourth shoulders;

wherein the first biasing element is disposed on the common pin between the first shoulder of the first slider block and the third shoulder of the common pin; and wherein the second biasing element is disposed on the common pin between the second shoulder of the second slider block and the fourth shoulder end of the common pin.

12. The centralizer of claim 11, wherein the first biasing element comprises a first stiffnesses; and wherein the second biasing element comprises a second stiffness different from the first stiffness.

13. The centralizer of claim 11, wherein a first shouldering distance between the first shoulder of the first slider block and the third shoulder of the common pin is greater than a second shouldering distance between the second shoulder of the second slider block and the fourth shoulder of the common pin.

14. The centralizer of claim 10, wherein the first biasing element comprises a first stiffnesses, and the second biasing element comprises a second stiffness different from the first stiffness; and/or wherein the initial extent is shorter than the subsequent extent.

15. The centralizer of claim 10, wherein the centralizer comprises a plurality of first radial supports, each of the radial supports having a set of the first and second arms.

16. The centralizer of claim 10, wherein the first slider block comprises a first shoulder facing away from the dividing upset;

wherein the common pin is connected from the second slider block and is disposed through the first shoulder on the first slider block, the common pin having a second shoulder;

wherein the first biasing element is disposed on the common pin between the first shoulder of the first slider block and the second biasing element; and wherein the second biasing element is disposed on the common pin between the second shoulder of the common pin and the first biasing element.

17. A centralizer for use on a wireline tool in casing having a number of inner diameters, the wireline tool having a mandrel, the centralizer comprising:

a sleeve disposed on the mandrel, the sleeve having a dividing upset;

a first slider block disposed on the sleeve on a first side of the dividing upset;

a second slider block disposed on the sleeve on a second side of the dividing upset, the first and second slider blocks being separable from one another;

a first arm hingedly connected to the first slider block;

a second arm hingedly connected to the second slider block and hingedly connected to the first arm;

a first biasing element arranged between the first and second slider blocks; and a second biasing element arranged between the first and second slider blocks, the first biasing element biasing an initial extent of separation between the first and second slider bocks, the second biasing element biasing a subsequent extent of the separation between the first and second slider bocks.

18. The centralizer of claim 17, wherein the first slider block comprises a first shoulder facing away from the dividing upset;

wherein the second slider block comprises a second shoulder facing away from the dividing upset;

wherein the centralizer comprises a common pin disposed through the first and second shoulders on the respective slider blocks, the common pin having third and fourth shoulders;

wherein the first biasing element is disposed on the common pin between the first shoulder of the first slider block and the third shoulder of the common pin; and wherein the second biasing element is disposed on the common pin between the second shoulder of the second slider block and the fourth shoulder end of the common pin.

19. The centralizer of claim 18, wherein a first shouldering distance between the first shoulder of the first slider block and the third shoulder of the common pin is greater than a second shouldering distance between the second shoulder of the second slider block and the fourth shoulder of the common pin.

20. The centralizer of claim 17, wherein the first biasing element comprises a first stiffnesses, and the second biasing element comprises a second stiffness different from the first stiffness; and/or wherein the initial extent is shorter than the subsequent extent.

21. The centralizer of claim 17, wherein the centralizer comprises a plurality of first radial supports, each of the radial supports having a set of the first and second arms.

22. The centralizer of claim 17, wherein the first slider block comprises a first shoulder facing away from the dividing upset;

wherein the centralizer comprises a common pin connected from the second slider block and disposed through the first shoulder on the first slider block, the common pin having a second shoulder;

wherein the first biasing element is disposed on the common pin between the first shoulder of the first slider block and the second biasing element; and wherein the second biasing element is disposed on the common pin between the second shoulder of the common pin and the first biasing element.

* * * * *